US005394312A

United States Patent [19]

Bland

[11] Patent Number: 5,394,312

[45] Date of Patent: Feb. 28, 1995

[54] LUMINAIRE-PROVIDED FOOTWEAR

[76] Inventor: Todd A. Bland, 4301 Abbott Rd., Lincoln, Nebr. 68516

[21] Appl. No.: 270,471

[22] Filed: Jul. 5, 1994

Related U.S. Application Data

[63] Continuation-in-part of Ser. No. 38,894, Mar. 29, 1993, Pat. No. 5,329,432.

[51] Int. Cl.[6] ..... A43B 23/24

[52] U.S. Cl. ..... 362/103; 362/183; 36/137

[58] Field of Search ..... 362/103, 183; 36/137, 36/136

[56] References Cited

U.S. PATENT DOCUMENTS

| | | | |
|---|---|---|---|
| 4,438,482 | 3/1984 | Leon et al. | 362/103 |
| 4,848,009 | 7/1989 | Rodgers | 362/103 |
| 5,211,470 | 5/1993 | Frost et al. | 362/183 |

*Primary Examiner*—Ira S. Lazarus
*Assistant Examiner*—L. Heyman

[57] ABSTRACT

Athletes' shoes or other analagously selectable footwear conventionally having opposed vampwalls is modifiably augmented to provide at least one firstly transversely outwardly extending and secondarily longitudinally rearwardly extending part that is terminally rearwardly provided with an energizeable luminaire. A parallel plurality of such terminally rearwardly luminaire-type hollow tubes might emanate from vertically-arranged vampwall-openings and extending semi-rigidly cantileverly from each such vampwall-opening.

11 Claims, 2 Drawing Sheets

LUMINAIRE-PROVIDED FOOTWEAR

RELATED PATENT APPLICATION

Please make "of record" aplicant-Bland's continuation-in-part U.S. patent application Ser. No. 08/038.894, filed March 29, 1993, now U.S. Pat. No. 5,329,432.

BACKGROUND OF THE INVENTION

Primarily, for aesthetic reasons, the prior art describes luminaire-provided footwear, but such prior art footwear is neither intended nor designed for adequately illuminating the front-to-rear longitudinal pathway taken by nightway walkers and/or joggers to alert longitudinally-coming roadway vehicles. Moreover, prior art luminaire-provided footwear tend to be cumbersomely located, uncomfortable to the footwear wearer, and/or difficult to repair or replace once the incandescent lamp or power source therefor wears-out or misfunctions.

GENERAL OBJECTIVE OF THE INVENTION

It is the general objective of the present invention to provide luminaire—provided footwear that has capability for adequately illuminating the directionally longitudinal pathway being taken by nocturnally walking and/or running persons so as to alert them and longitudinally moving persons of perils that might exist along the runner and/or walkers longitudinally intended pathway.

It is another objective to provide luminaire-provided footwear possessing luminescent aesthetic features not envisioned by prior art workers.

It is another objective to provide luminaire-provided footwear wherein the luminaire system therefor is tidily and inconspicuously located, and does not provide physical discomfert to the wearer, and is easy to replace, maintain, or repair, once the incandescent lamp and/or the lamp energing power components wear-out or misfunction.

GENERAL STATEMENT OF THE INVENTION

With the above-mentioned general objective in view, and together with other ancillary and related objectives which will become more apparent as this description proceeds, the luminaire-provided footwear concept of the present invention is primarily based upon selectable conventional footwear which conventionally includes upright vampwalls parallelly flanking a directionally longitudinal central upright-plane, and which conventional footwear at least one of its upright vampwalls is non-conventionally augmented with:

at least one (and desireably optionally with a plurality of) vampwall-openings provided at each said vampwall-opening, a semi-rigid tube extending cantileverly firstly outwardly from and secondarily longitudinally rearwardly to terminate as a tube rearward-end; and an electrically energizeable incandescent bulb (or the like) rearwardly carried by each such semi-rigid and cantileverly extending hollow tube.

BRIEF DESCRIPTION OF THE DRAWING

In the drawing, wherein like characters refer to like parts in the several views, and in which.

DETAILED DESCRIPTION OF THE DRAWING

Figure 3:
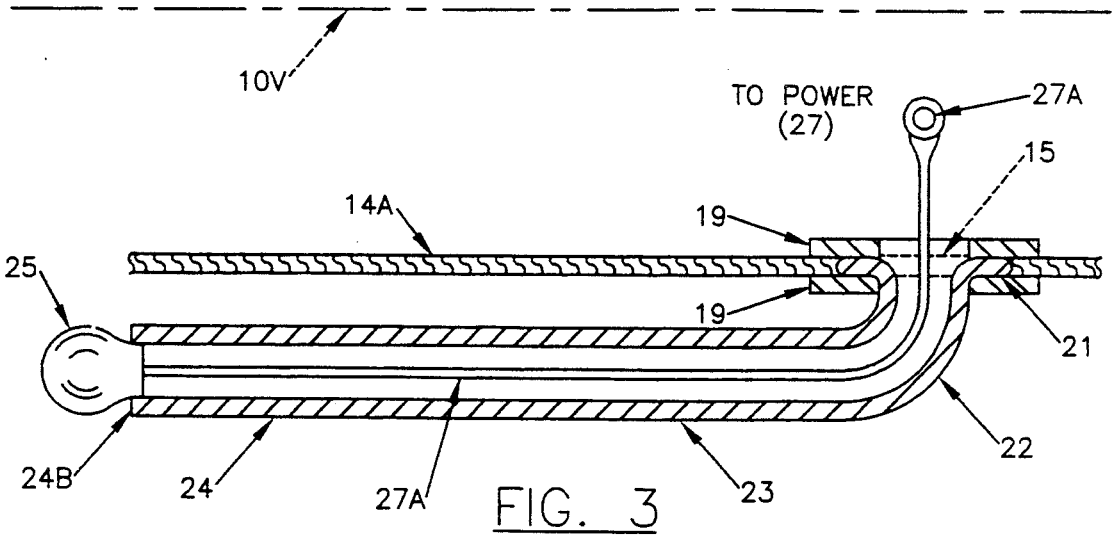
FIG. 3 is a sectional plan view taken along lines 3—3 of FIGS. 1 and 2.
Figure 1:
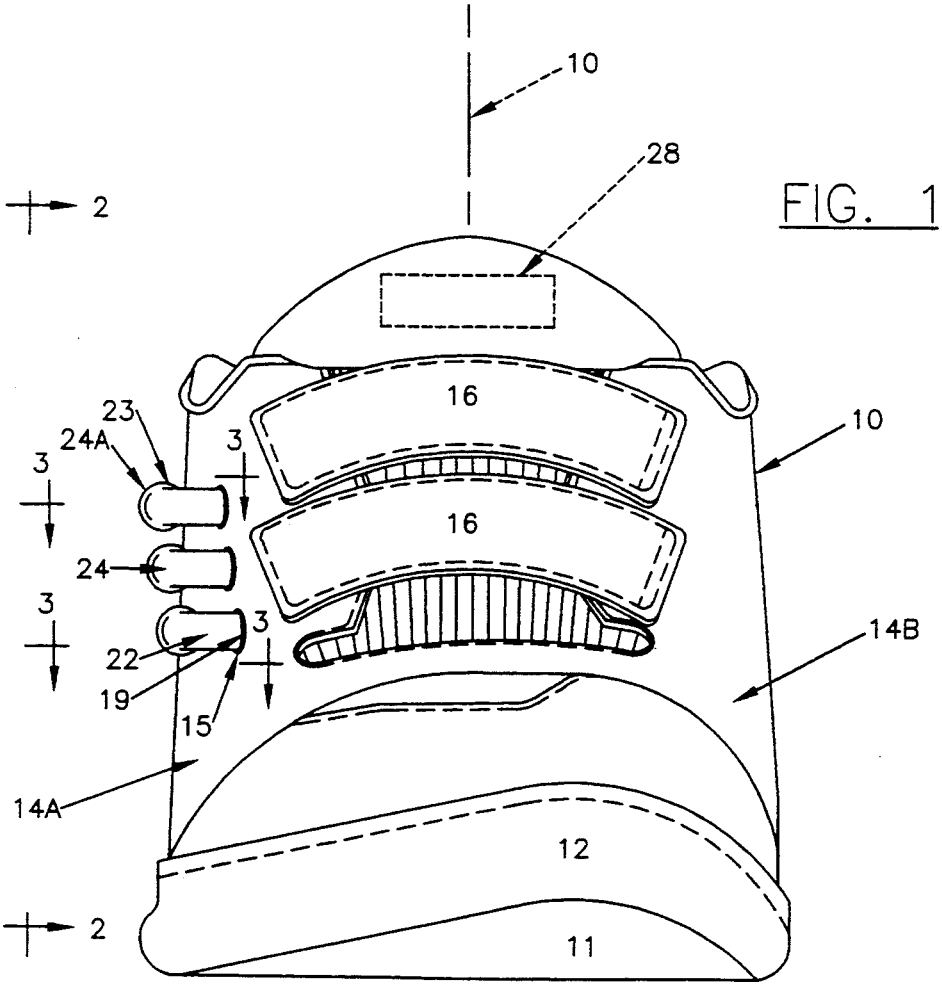
FIG. 1 is a frontal elevational view of a representative embodiment (9, 10, 20) of the luminaire-provided footwear of the present invention.
Figure 2:
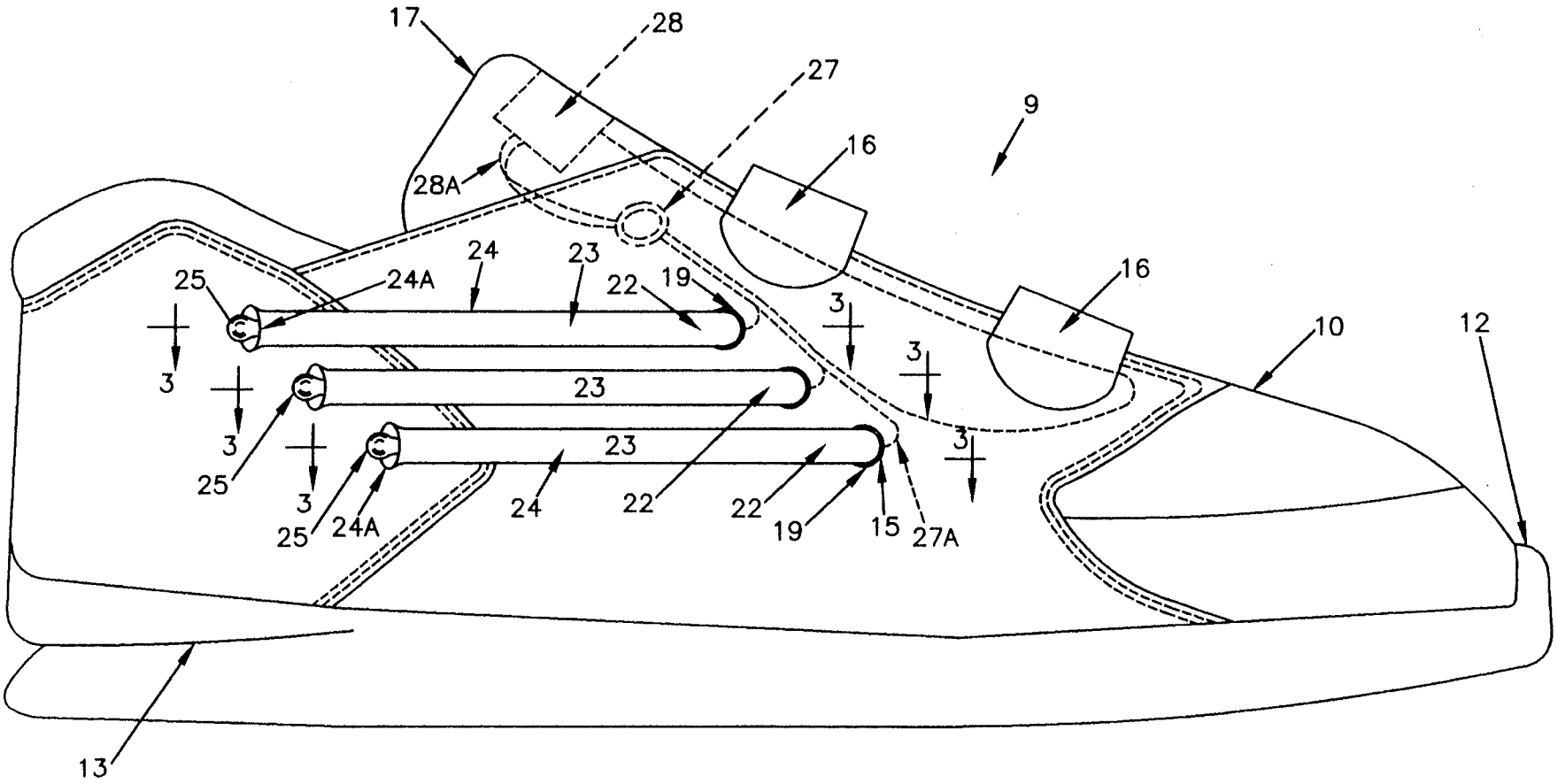
FIG. 2 is a directionally longitudinally extending (parallel to upright central-plane 10V) taken along line 2—2 of FIG. 1.

The luminaire-provided footwear (e.g. embodiment 9) of the present invention comprises selectable footwear (e.g. athletic shoe 10) for male and/or female persons sidewardly (e.g. 14A) provided with one or more horizontally rearwardly beaming type (e.g. 25) footwear luminaire system (e.g. 20).

Representative embodiment footwear 10 typically comprises: a generally horizontal underlying outersole 11 centrally intersected by a directionally longitudinally extending central upright-plane 10A extending between a directionally transverse upright tow 12 and a directionally transverse upright heel 13; and a foot-accomodative hollow vamp 14 attached to and extending uprightly from said outersole 11 and including a pair of directionally longitudinally extending upright and directionally transversely separated upright vampwalls 14A–14B flanking upright plane 10A. Vamp 14 also includes a flexible tongue 17 that is centrally intersected by upright plane 10A, and with lacing or straps (16), spanning tongue 17, for exerting tension between the upright vampwalls (14A, 14B).

In the present invention, selectable footwear (e.g. 10) is augmented with a luminaire system (e.g. 20) comprising an incandescent lamp portion (e.g. lightbulb 25) and energizer therefor (e.g. a chemical storage battery 27). Each such incandescent lamp portion (e.g. bulb 25) is removably carried at the rearward-end (24A) of a tube 23 which extends semi-rigidly cantileverly from a vampwall-opening (15). For example, a such bulb 25 might be frictionally surrounded by tube 23 at the rearward-end 24A thereof. Each such hollow tube communicates with a said vampwall-opening and is attached the adjacent vampwall (e.g. with a grommet 19 embracing a tube forward flange 21). Accordingly, each such semi-rigid tube extends cantileverly:

(a) firstly, as a fore-length (22) extending transversely outwardly from the attached vampwall (14,19,21); and (b) secondly, as a rear-length (24) extending horizontally rearwardly from said fore-length (22) to said rearward-end 24A.

A selected vampwall (e.g. 14A) might optionally be provided with a plurality of vertically-arranged vampwall-openings (15) each of which can be analagously provided with a said semi-rigid cantilever tube (23) rearwardly equippable with a luminaire (e.g. 25).

As to said previously mentioned energizer powering means: Carriable by said at least one perforated (15) upright vampwall (e.g. 14A) is a chemical storage battery (e.g. chemical storage battery 27) which is electrically connected (e.g. by metallic wires 27A thru each tube 23) to an energizeable lamp (e.g. 25). Optionally employable for re-energizing a said chemical storage battery (27) is a solarenergy-conversion unit 28 for electrically-recharging a said battery (27) thru conductor-wires (28A).

From the foregoing, the construction and operation of the "luminaire-provided footwear" will be readily understood and further explanation is believed to be unnecessary. However, since numerous modifications and changes will readily occur to those skilled in the art, it is not desired to limit the invention to the exact construction shown and described, and accordingly, all suitable modifications and equivalents may be resorted to, falling within the scope of the appended claims.

I claim:

1. For footwear conventionally comprises: a generally horizontal underlying outersole extending directionally longitudinally between a frontal and directionally transverse upright toe and a rearward upright heel; and a hollow vamp attached to and extending upwardly from said outersole and including a pair of directionally longitudinally extending upright and directionally separated upright vampwalls; the improvement of luminaire provided footwear comprising:

(a) at least one of said vampwalls being provided with at least one vampwall-opening therethrough;

(b) at least one generally horizontal tube each having an annular fore-end attached to said vampwall in surrounding relationship to a corresponding one of said at least one vampwall-opening, each said tube firstly extending directionally transversely rigidly outwardly from each said vampwall-opening and tube fore-end and thence secondly extending directionally longitudinally rearwardly to terminate as an tube annular rear-end; and (c) at least one electrically energizeable luminaire attached to each said tube immediately adjacent the tube rear-end.

2. The luminaire provided footwear of claim 1 wherein said at least one vampwall-opening comprises a plurality of vertically-spaced vampwall-openings; and wherein each of said vampwall-openings is attachably provided with one of said at least one tube having one of said at least one rear-end luminaire.

3. The luminaire provided footwear of claim 1 wherein a chemical storage battery is carried by said vampwalls and wherein each said at least one tube is provided with a conductive wire therein thereby connecting said chemical storage battery to each said at least one luminaire.

4. The luminaire provided footwear of claim 3 wherein each said at least one luminaire takes the form of an incandescent bulb and is removably attached within each said at least one tube adjacent the rear-end thereof.

5. The luminaire provided footwear of claim 4 wherein the footwear is provided with a solarenergy-conversion unit connected to and for electrically-recharging said chemical storage battery.

6. The luminaire provided footwear of claim 2 wherein a chemical storage battery is carried by said vampwall; and wherein, within each said tube, an electrically conductive wire connects said chemical storage battery to each said rear-end luminaire.

7. The luminaire provided footwear of claim 6 wherein each said luminaire comprises an incandescent bulb removably emplaced within a tube adjacent the annualar rear-end thereof.

8. The luminaire provided footwear of claim 1 wherein a dually-flanged grommet is employed to attach the said tube fore-end of each said at least one tube to said vampwall; and wherein each said at least one luminaire comprises an electrically-actuatable incandescent bulb type luminaire.

9. The luminaire provided footwear of claim 8 wherein a chemical storage battery is carried by said vampwall; and wherein each said at least one tube is provided with a conductive wire therein thereby connecting said chemical storage battery to each said at least one luminaire.

10. The luminaire, provided footwear of claim 9 wherein said at least one vampwall-opening comprises a plurality of vertically-spaced vampwall-openings; and wherein each said tube surrounds one of each said electrically conductive wire emanating from a single said chemical storage battery.

11. The luminaire provided footwear of claim 1 wherein said luminaire comprises a laser-type module carried each a said at least one tube adjacent the tube rear-end.

* * * * *